United States Patent [19]
Dock
[11] 4,209,026
[45] Jun. 24, 1980

[54] METHOD OF SECURING A FILTERING MASS FOR TOBACCO SMOKE WITHIN A HOUSING ENCOMPASSING SAID MASS

[76] Inventor: Mortimer R. Dock, 2111 Jeff Davis Hwy., Arlington, Va. 22202

[21] Appl. No.: 857,022

[22] Filed: Dec. 2, 1977

[51] Int. Cl.² ..... A24F 13/02
[52] U.S. Cl. ..... 131/187
[58] Field of Search ..... 131/190, 191, 267, 10.1, 131/173, 261 A, 187

[56] References Cited

U.S. PATENT DOCUMENTS

| | | | |
|---|---|---|---|
| 2,006,015 | 4/1934 | Droop | 131/187 |
| 3,513,859 | 11/1967 | Carty | 131/173 |
| 4,049,005 | 9/1977 | Hernandez | 131/187 |

*Primary Examiner*—Robert W. Michell
*Assistant Examiner*—Thomas Wallen

[57] ABSTRACT

This invention relates to a containment member matably assembled within a substantially cylindrical housing having therewithin a mass of filtering material such as water-reactive, expansible fibrous material and at least one frangible body having a liquid content, both of said containment member and said housing being made of resilient, impervious materials of the type generally designated as plastics, and each having one end open and at the opposite end an integral disc having multiple perforations for the passage of smoke therethrough.

1 Claim, 7 Drawing Figures

METHOD OF SECURING A FILTERING MASS FOR TOBACCO SMOKE WITHIN A HOUSING ENCOMPASSING SAID MASS

This invention constitutes an improvement over the presently known filters for tobacco smoke, for use with cigarettes and small cigars, which filters employ water-reactive, expansible fibrous material, herein for convenience sometimes referred to as "sponge", and at least one frangible, substantially spherical body having a liquid content, preferably water, said sponge and frangible body being contained within a resilient, impervious, substantially cylindrical housing.

The housing of this invention is of substantially cylindrical contour, having at one end a perforated disc integrally formed with the cylinder, and the opposite end of the housing is enlarged for the receipt and accommodation of a containment member of like cylindrical contour.

The containment member used with cigarettes is a tube, closed at one end by an integral perforated disc and open at the opposite end for receipt and accommodation of a cigarette. The containment member is herein sometimes referred to as a "closure thimble".

When used with small cigars, of the size generally referred to as "cigarillos," the containment member may be either a shortened thimble or a rod of conventional acetate tow, inserted into the housing and securing therein the filter mass of sponge and frangible bodies.

The housing is filled with alternate charges of sponge and frangible bodies, or "capsules", and the containment member is inserted, closed end first, into the housing. The filter is then ready for use, and is activated by lateral compression, or squeezing, of the central area of the housing, thus rupturing the capsules and releasing their water content into the adjacent sponge. This feature of the filter was first disclosed in patents Nos. 3,366,121 and 3,502,084 and is not claimed as a patentable feature of the present invention, except in combination with the housing and containment means.

In the present invention, the integral perforated discs forming the closed ends of the housing and the thimble permit ready flow of the cigarette smoke into and through the filter mass and into the smoker's mouth.

For a better understanding of this invention, reference is directed to the accompanying drawings, wherein FIG. 1 is a perspective view showing the side and the closed end of the filter housing of this invention.

Figure 1:
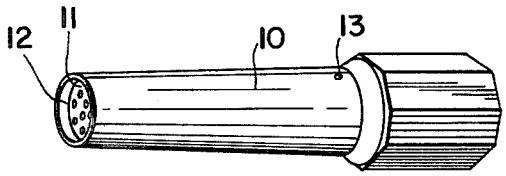
Figure 2:
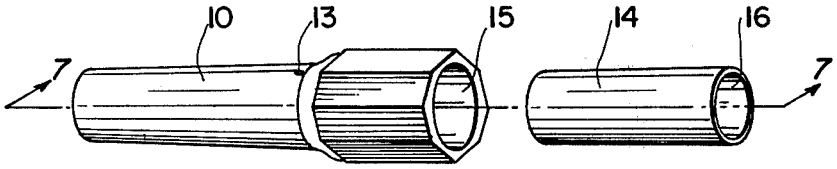
FIG. 2 is a perspective view showing the side and the open end of the housing, prior to insertion of the closure member.

Referring more particularly to the drawings,

In FIG. 1, filter housing 10 has at one end a perforated disc 11, integral with and slightly recessed as at 12 within the substantially cylindrical walls of the housing and having at least one minute aperture 13 in said wall to reduce the resistance to draw when smoking a cigarette; and in FIG. 2, closure thimble 14 is shown ready for insertion into the open end 15 of said housing 10, the open end of thimble 14 forming a chamber 16 for the receipt and accommodation of the end of a cigarette. The aperture 13 is an optional feature which is employed in filters intended for use with regular cigarettes, i.e., those having a relatively high tar and nicotine rating.

Figure 3:
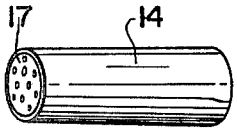
FIG. 3 is a perspective view of the closure thimble, taken from the closed end thereof.

FIG. 3, being a view of thimble 14, shows at its closed end a disc 17, integrally formed with said thimble and perforated in the same manner as the closure disc 11 of the housing. The taper of the thimble, growing larger toward the open end, is desirable for facilitating withdrawal of the mold parts during fabrication, and is advantageous because the enlarged open end will more readily receive the end of a cigarette, which is then pushed into the thimble until it nears the perforated disc.

Figure 4:
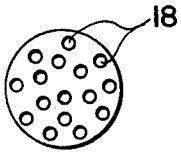
FIG. 4 is a top plan of the integral disc forming the closed end of each of the housing and the thimble, the perforations being of like size and arrangement.

The perforations 18, 18 shown in the disc of FIG. 4 permit ready passage of smoke from the thimble into the filter mass and thence into the smoker's mouth.

Figure 5:
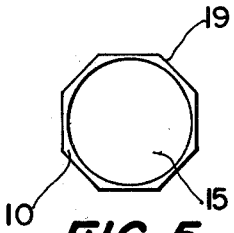
FIG. 5 is a top plan of the open end of the housing.

The exterior of housing 10 at its open end 15 is multi-faced, as is indicated by the polygonal contour 19 shown in the cross-section of FIG. 5.

Figure 6:
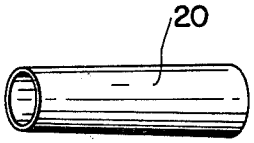
FIG. 6 shows a perspective view of a sleeve, insertable within the thimble to reduce the inside diameter thereof and thus provide secure holding of cigarettes of less than standard ring size, some of which are customarily referred to as "slim" cigarettes.

The tapered sleeve 20 shown in FIG. 6 is inserted into the thimble for the secure accommodation therein of a cigarette of less than standard ring size.

Figure 7:
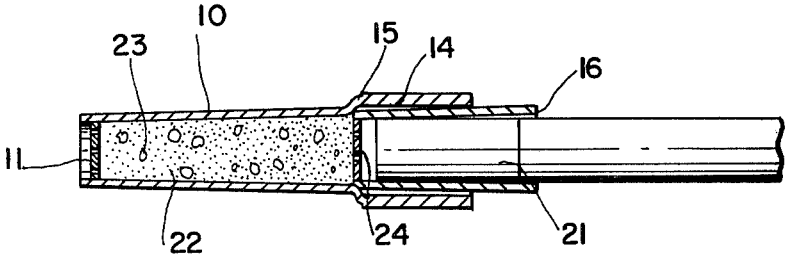
FIG. 7 is a cross-sectional view taken on line 7—7 of FIG. 2, but with the filter mass and closure thimble in assembled position and a cigarette inserted into the thimble.

In FIG. 7 the cross-sectional view shows the housing 10, housing closure disc 11, thimble 14 contained in the open end 15 of the housing and having a cigarette 21 inserted into chamber 16 of the thimble, with sponge 22 and frangible bodies 23 comprising the filter mass.

The multi-faced exterior 19 of the open end of the housing, encompassing chamber 15, prevents the cigarette from rolling off the edge of a surface such as an ashtray, a table, etc.

When the filter is used with a small cigar, the polygonal contour of the exterior of the housing is required to facilitate the application of the filter on the end of a small cigar. (The filter is reusable with cigarettes, but with small cigars it is used only once; hence its attachment, preferably by adhesion, upon the cigar at the factory.) The machines for the application of conventional "tips" on small cigars are provided with jaws which grip opposed plane faces of the tip and hold it while the cigar is rotatably inserted into the tip. The same machines are employed to affix the filter of this invention on the end of a small cigar.

The space 24 in the closed end of the thimble, indicated in FIG. 7, between the perforated disc of the thimble and the end of the cigarette 21, serves as a cooling chamber for the last part of the smoke drawn at each puff on a burning cigarette. The circulation of the smoke held in this cooling chamber, though scarcely visible, serves to diffuse the smoke before it enters the filter mass.

The perforations in the integral discs of the housing and the closure thimble provide for parallel lines of smoke to be drawn through the filter mass. However, new smoke paths may be created by lateral compression of the housing after every few cigarettes, thus causing the smoke to travel through the filter mass between fibers not previously reached by the smoke.

Having thus described my invention, I claim:

1. A filter for use with smoking articles such as cigarettes and small cigars, having, in combination (a) a resilient, impervious, substantially cylindrical housing having at one end an integral perforated disc recessed from the end thereof and having the opposite end of said housing open for the receipt and accommodation of a containment member matable therewith;

(b) disposed within said housing a filter mass of water reactive, compressed, expansible, fibrous material and at least one frangible body having a liquid content therein;

(c) a member insertable into the open end of said housing for the containment therein of said filter mass, said member being a truncated cone having at the minor end an integral perforated disc and having the opposite end open for the receipt and accommodation of the end of a cigarette or small cigar;

(d) a tapered cylindrical insert member, open at both ends, for optional insertion into said containment member for the secure retention in said containment member of the end of a cigarette of less than the standard ring size of conventional cigarettes; and (e) a polyhedral configuration upon the exterior of the open end of said housing, said configuration extending a selected distance from the end of said housing, said polyhedral configuration serving to secure the housing in a tipping machine when a cigar is mechanically fitted into said open end of said housing.

* * * * *